US011466600B1

(12) United States Patent
Cofer, Jr. et al.

(10) Patent No.: US 11,466,600 B1
(45) Date of Patent: Oct. 11, 2022

(54) LUBRICATION FLUID FILTER BYPASS SYSTEM

(71) Applicant: Cummins Inc., Columbus, IN (US)

(72) Inventors: Stephen D. Cofer, Jr., Sugar Grove, PA (US); Ella Michelle Morris, Louisville, KY (US); Nickolas A. Springmeyer, Greensburg, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/202,522

(22) Filed: Mar. 16, 2021

(51) Int. Cl.
*F01M 1/10* (2006.01)
*F01M 1/08* (2006.01)
*F01M 11/02* (2006.01)

(52) U.S. Cl.
CPC ..... *F01M 1/10* (2013.01); *F01M 1/08* (2013.01); *F01M 11/02* (2013.01); *F01M 2001/083* (2013.01); *F01M 2001/1092* (2013.01); *F01M 2011/022* (2013.01)

(58) Field of Classification Search
CPC . F01M 1/10; F01M 1/08; F01M 11/02; F01M 2001/083; F01M 2001/1092; F01M 2011/022
USPC ..... 123/196 A
See application file for complete search history.

(56) References Cited

U.S. PATENT DOCUMENTS 3,065,743 A 11/1962 Brehm et al.
3,453,995 A * 7/1969 Pekar, Jr. ..... F01P 3/08 184/104.1
3,485,324 A * 12/1969 Novak ..... F01P 3/08 123/196 R
3,741,342 A 6/1973 Maddalozzo
7,883,621 B2 2/2011 Bontaz et al.
8,387,571 B2 3/2013 Ulrey et al.
2008/0053753 A1 3/2008 Chevalier et al.
2010/0294231 A1 11/2010 Kusel
2012/0138010 A1* 6/2012 Ulrey ..... F01M 5/02 123/196 R

FOREIGN PATENT DOCUMENTS

JP 49-50335 U 5/1974

OTHER PUBLICATIONS

International Search Report and Written Opinion, PCT Appln. No. PCT/US22/016719, dated May 25, 2022, 12 pgs.

* cited by examiner

*Primary Examiner* — Yi-Kai Wang
(74) *Attorney, Agent, or Firm* — Taft Stettinius & Hollister LLP

(57) ABSTRACT

An internal combustion engine includes an engine lubrication fluid system with a main rifle for distribution of filtered lubrication fluid to a plurality of engine components through a plurality of secondary rifles connected to the main rifle. The system also includes a bypass for bypassing the filter in response to certain engine operating conditions. The bypass is connected to at least one of the secondary rifles so that unfiltered lubrication fluid is not provided to certain engine components under filter bypass conditions, and provided directly to certain other engine components for which unfiltered lubrication fluid is less problematic.

20 Claims, 4 Drawing Sheets

LUBRICATION FLUID FILTER BYPASS SYSTEM

FIELD OF THE INVENTION

This invention relates to an internal combustion engine including a lubrication system, and more particularly to a filter bypass system for an engine lubrication fluid.

BACKGROUND

In an internal combustion engine, a supply of lubrication fluid, such as engine oil, is provided in an oil pan or sump at the bottom of the engine. The cylinders and other components in an internal combustion engine require lubrication and/or cooling with the lubrication fluid to be able to operate properly. During engine operation, a pump is used to carry the lubrication fluid from the sump, through a filter, and into the working portions of the engine in order to lubricate the engines moving parts and to provide other functions. The lubrication fluid is continuously supplied to these moving components, and the lubrication fluid is returned to the sump through various paths by gravity flow.

In order to maintain the filter in working order and to allow engine lubrication in the event the filter is clogged, a filter bypass is provided. The filter bypass typically opens automatically in response to high fluid pressure conditions at the filter, and allows unfiltered lubrication fluid to bypass the filter and flow directly to the main rifle for distribution of the unfiltered lubrication fluid to the engine components. As a result, any debris in the bypassed lubrication fluid is circulated to each of the engine components connected to the lubrication circuit. Therefore, further improvements in lubrication fluid circulation during filter bypass conditions are needed.

SUMMARY

Embodiments include an internal combustion engine including an engine lubrication fluid system with a filter and a filter bypass in a lubrication fluid circuit. The filter is connected to the main rifle of the lubrication fluid circuit so filtered fluid is circulated to all the engine components connected to the lubrication fluid circuit. The bypass is connected directly to a secondary rifle, such as the piston cooling nozzle rifle, of the lubrication fluid circuit downstream of the main rifle. Bypassed, unfiltered lubrication fluid bypasses the main rifle and is sent through the bypass directly to secondary component(s) for which unfiltered lubrication fluid is less problematic, such as the piston cooling nozzles. As a result, the main bearings and other components connected to the main rifle upstream of the secondary component(s) are not sent unfiltered lubrication fluid during filter bypass operating conditions.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
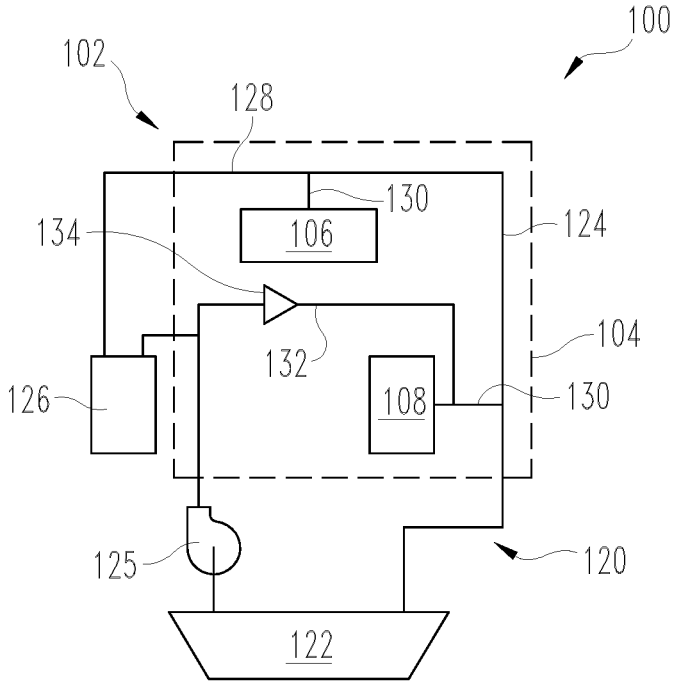
FIG. 1 is a schematic depiction of an internal combustion engine lubrication fluid system with a filter and a filter bypass.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1 an internal combustion engine system 100 includes an internal combustion engine 102 with a block 104 housing and/or supporting a plurality of components 106, 108 such as crankshaft(s), a plurality of cylinders, pistons, bearings, valve trains, gears, piston cooling nozzles, pumps, housings, turbines, etc. that would normally be found on an internal combustion engine. The system 100 further includes a lubrication fluid system 120 for lubrication and/or cooling.

The lubrication fluid system 120 circulates a lubrication fluid, such as oil, to the plurality of components 106, 108 and receives the lubrication fluid from the plurality of components 106, 108 for filtering and/or recirculation. In an embodiment discussed herein, first component(s) 106 may include, for example, bearings and/or overhead valve train components. Second components 108 may include, for example, piston cooling nozzle(s). First component(s) 106 are normally upstream of the second component(s) 108, and circulation of unfiltered lubrication fluid to first component(s) 106 is typically more problematic than it is for second component(s) 108 since second component(s) 108 are less sensitive to debris in the lubrication fluid.

The internal combustion engine 102 may be any type of internal combustion engine that requires lubrication, including at least a diesel, gasoline, or natural gas engine, and/or combinations thereof. The internal combustion engine 102 can include a single cylinder bank, a dual cylinder bank, or any cylinder bank arrangement. Any numbers of cylinders and cylinder arrangements are contemplated for internal combustion engine 102.

The lubrication fluid system 120 includes a sump 122 that is connected to the plurality of components 106, 108 with a fluid circuit 124. The fluid circuit 124 includes a filter 126 connected to the sump 122. A pump 125 can provide lubrication fluid to filter 126 to filter the lubrication fluid before circulation to components 106, 108. The outlet of filter 126 is connected to a main rifle 128 that may be formed wholly or in part in block 104. The filtered lubrication fluid is provided to main rifle 128 for distribution to the plurality of components 106, 108 via a plurality of secondary rifles 130*a*, 130*b* that may be formed wholly or in part in block 104. The lubrication fluid drains from the plurality of components 106, 108 for collection at sump 122.

The lubrication fluid system 120 further includes a bypass 132 formed wholly or in part by a rifle in block 104. Bypass 132 includes a pressure-responsive bypass valve 134 that normally prevents lubrication fluid from flowing into bypass 132. Therefore, lubrication fluid is normally filtered and provided to main rifle 128 from filter 126. However, in response to high pressure conditions in the fluid circuit 124 at filter 126, such as due to a clogged filter 126 and/or cold start conditions, bypass valve 134 opens so that lubrication fluid bypasses the filter 126 and is circulated into bypass 132, bypassing the main rifle 128.

Bypass 132 is not connected to main rifle 128, therefore the unfiltered lubrication fluid is not circulated to all of the plurality of components 106, 108. Instead, bypass 132 is connected to at least one of the secondary rifles 130*b* such that the unfiltered lubrication fluid is provided directly to second component(s) 108, and therefore the first component(s) 106 are not provided unfiltered lubrication fluid, at least under most filter bypass operating conditions. In an embodiment, the at least one secondary rifle 130*b* is a piston cooling nozzle rifle and the second component(s) 108 are piston cooling nozzles.

Figure 2A:
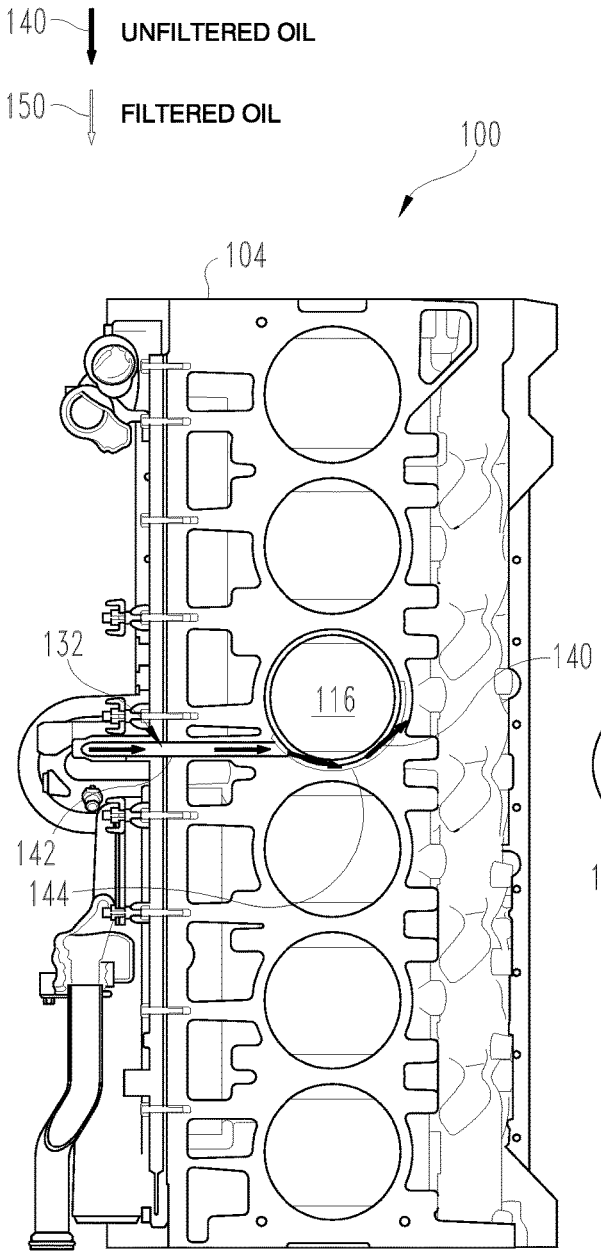
FIGS. 2A and 2B are sectional views through an internal combustion engine showing flow paths for the lubrication fluid with the filter bypass open.
Figure 2B:
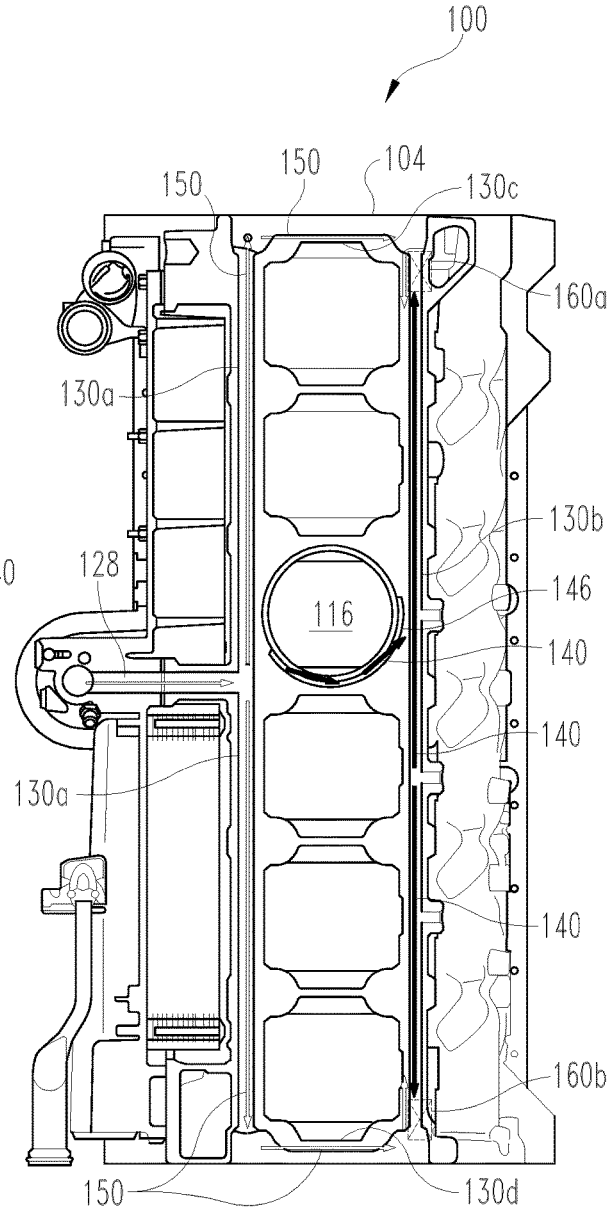

Referring further to FIGS. 2A-2B, the lubrication fluid circuit 124 is shown in when bypass valve 134 is open. Block 104 includes bypass 132 (FIG. 2A) that is formed in block 104 at a location that is offset in elevation above main rifle 128 (FIG. 2B). Block 104 includes a piston cooling nozzle secondary rifle 130*b* that is connected to bypass 132. Block 104 also includes a plurality of secondary rifles 130*a*, 130*c*, 130*d* connected to main rifle 128 at the same elevation as main rifle 128, as shown in FIG. 2B. Secondary rifles 130*c*, 130*d* are also connected to opposite ends of secondary riddle 130*b*.

Unfiltered filtered lubrication fluid 140 is provided directly to bypass 132 for distribution directly to the secondary rifle 130*b* for distribution to the piston cooling nozzles. Since the secondary rifle 130*b* is on the side of block 104 that is opposite of the filter 126, the bypass 132 traverses the block 104 for direct connection to secondary rifle 130*b*. Bypass 132 is formed by a rifle with a first part 142 extending from bypass valve 134 to cylinder 116, a second part 144 extending around cylinder 116, and a third part 146 extending from cylinder 116 to secondary rifle 130*b*. Unfiltered lubrication fluid 140 fills secondary rifle 130*b* directly from bypass 132 for distribution to the second component(s) 108, such as the piston cooling nozzles. Meanwhile, filtered lubrication fluid 150 is maintained in main rifle 128 and in the other secondary rifles 130*a*, 130*c*, 130*d* for distribution to the first component(s) 106.

Although not required, check valves 160*a*, 160*b* (FIG. 2B) may be provided at the junction of secondary rifle 130*b* with secondary rifles 130*c*, 130*d*. The check valves 160*a*, 160*b* can assist in preventing or reducing reverse flow of unfiltered lubrication fluid 140 from secondary rifle 130*b* to the first component(s) 106. However, check valves 160*a*, 160*b* are not required in all embodiments, and some embodiments envision some mixing of filtered and unfiltered lubrication fluid in all or a part of the secondary rifles 130*a*, 130*b*, 130*c*, 130*d*. The pressure differential between the filtered and unfiltered lubrication fluid can be maintained to prevent the flow of unfiltered lubrication fluid from secondary rifle 130*b* to first component(s) 106 under most operating conditions.

Figure 3A:
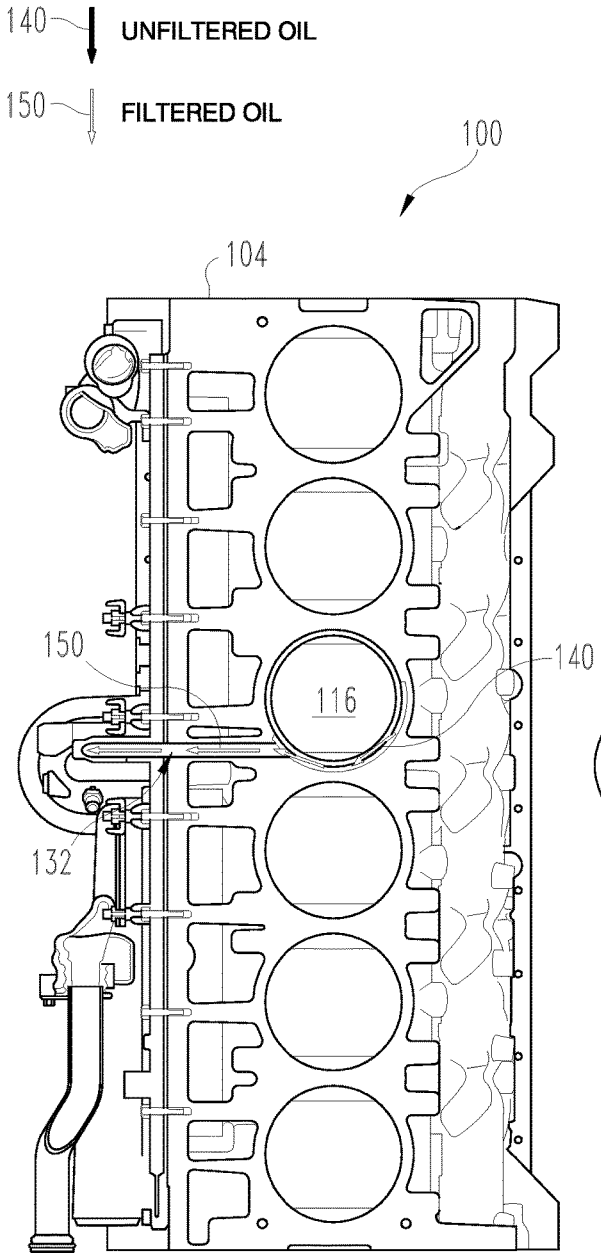
FIGS. 3A and 3B are sectional views through the internal combustion engine showing flow paths for the lubrication fluid with the filter bypass closed.
Figure 3B:
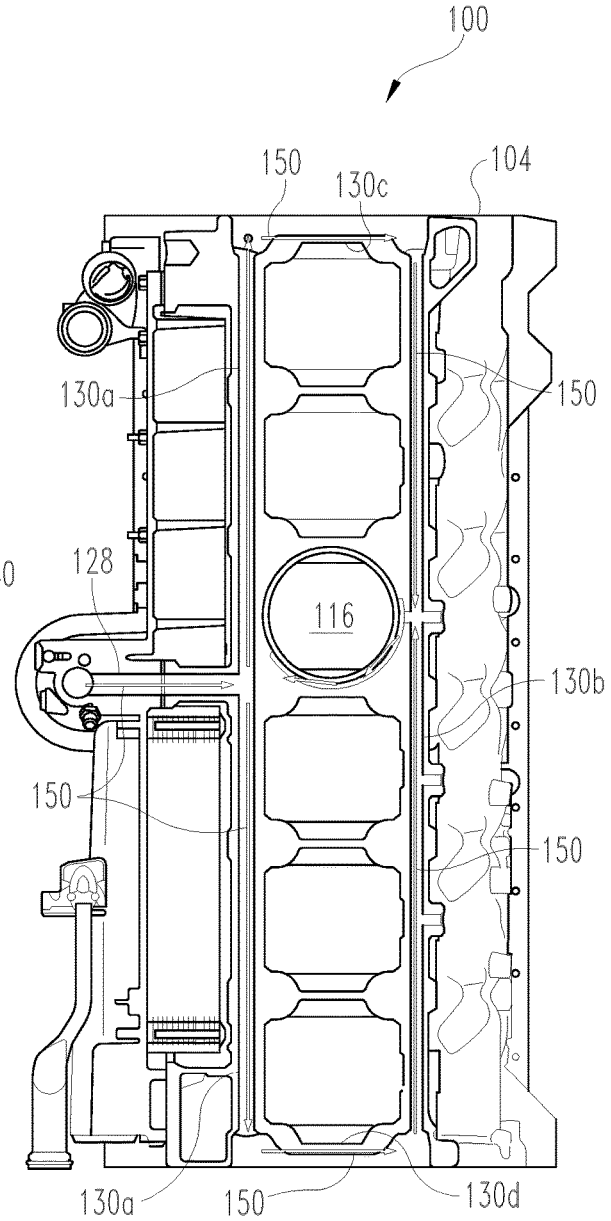

Referring further to FIGS. 3A-3B, the lubrication fluid circuit 124 is shown in a condition in which bypass valve 134 is closed. With the bypass valve 134 closed, no unfiltered lubrication fluid enters the lubrication fluid circuit 124 via bypass 132. Filtered lubrication fluid 150 is provided from filter 126 to main rifle 128, and then to secondary rifles 130*a*, 130*c*, 130*d* for distribution to the first component(s) 106 and to second component(s) 108 via secondary rifle 130*b*. Any unfiltered lubrication fluid 140 is forced from secondary rifle 130*b* back into bypass 132, and into filter 126.

Figure 4:
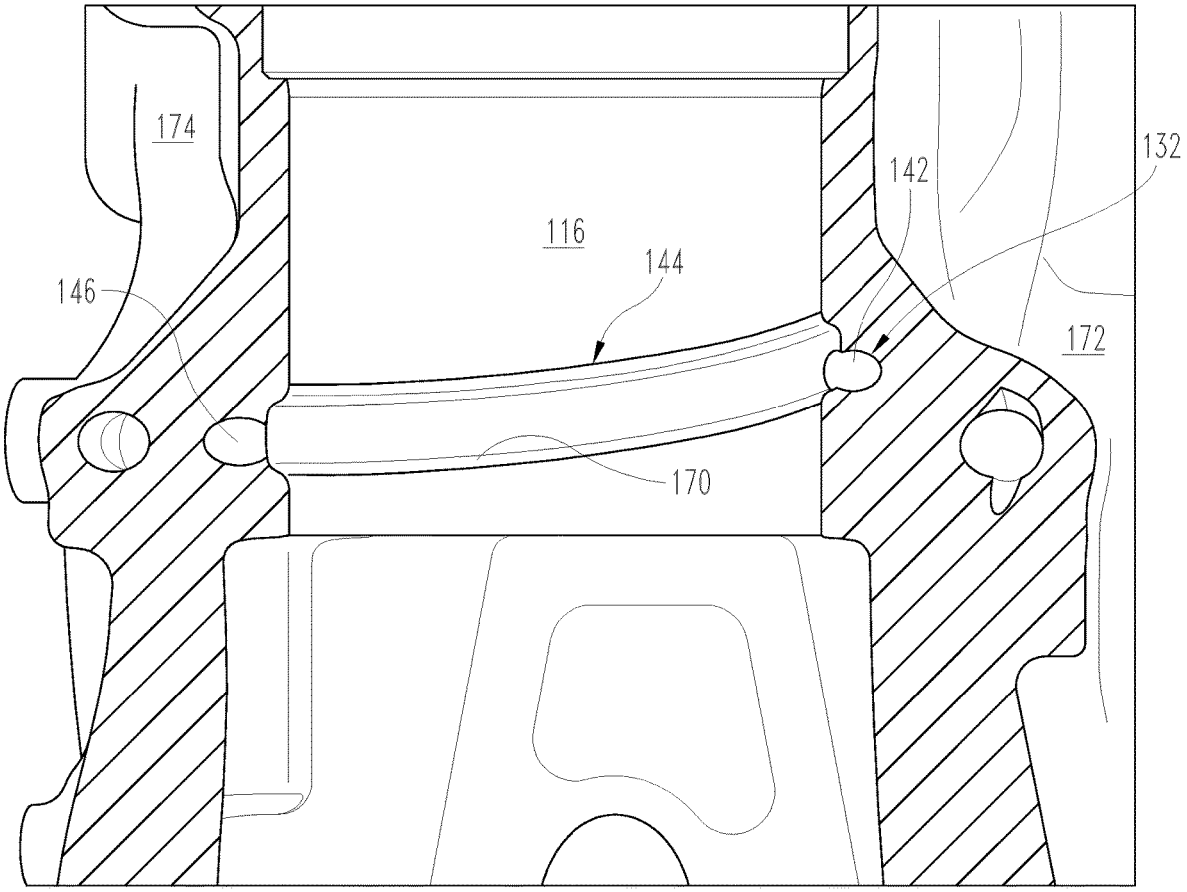
FIG. 4 is a sectional view of a cylinder showing the part of the bypass around a cylinder of the engine block.

Referring to FIG. 4, an embodiment of bypass 132 is shown in which the outer side of the second part 144 of bypass 132 is formed as a groove 170 cast in or otherwise formed by block 104. Groove 170 extends around a part of an outer perimeter of cylinder 116. The inner or other side of the passage defined by second part 144 is formed by the liner (not shown) of cylinder 116. Unfiltered lubrication fluid 140 enters the second part 144 of bypass 132 on the hot or exhaust side 172 of cylinder 116. Second part 144 slopes downwardly in elevation to an exit at the cold or intake side 174 of cylinder 116 that is connected to secondary rifle 130*d*. The sloped arrangement of bypass 132 allows unfiltered lubrication fluid to drain into the secondary rifle 130*b* and into second component(s) 108 when the engine is shut down.

Various aspects of the present disclosure are contemplated as indicated in the claims appended hereto. According one aspect, a system includes an internal combustion engine including a block, a plurality of components supported by the block, and a lubrication fluid for lubricating the plurality of components. The system also includes a lubrication fluid circuit for circulating a supply of the lubrication fluid to lubricate the plurality of components. The lubrication fluid circuit includes a sump for storing lubrication fluid to be filtered, a filter connected to the sump for filtering lubrication fluid upstream of the plurality of components, a main rifle in the block connected to the filter for receiving filtered lubrication fluid for distribution to the plurality of components through a plurality of secondary rifles in the block that are connected to the main rifle, and a bypass connected to receive unfiltered lubrication fluid that bypasses the filter. The bypass is directly connected to at least one of the plurality of secondary rifles downstream of the main rifle.

In an embodiment, the bypass includes a pressure-responsive valve that normally blocks the flow of lubrication fluid through the bypass, and the pressure-responsive valve automatically opens in response to a lubrication fluid pressure above a predetermined threshold.

In an embodiment, the plurality of components includes a number of piston cooling nozzles and the at least one of the plurality of secondary rifles that is connected directly to the bypass is a piston cooling nozzle rifle.

In an embodiment, the bypass includes a first portion in the block extending from a cylinder housed by the block toward the filter, a second portion extending from the cylinder to the piston cooling nozzle rifle, and a third portion connecting the first and second portions that is formed around the cylinder between the block and a liner of the cylinder. In an embodiment, the third portion changes in elevation from the first portion to the second portion. In an embodiment, the third portion is wrapped around a part of a perimeter of the cylinder.

In an embodiment, the plurality of secondary rifles includes: a first secondary rifle along a first side of a plurality of cylinders housed in the block; a second secondary rifle extending from a first end of the first secondary rifle along a first end of the block; a third secondary rifle extending from a second end of the first secondary rifle along a second end of the block; and a piston cooling nozzle rifle along a second side of the plurality of cylinders that connects the second secondary rifle and the third secondary rifle. The bypass is directly connected to the piston cooling nozzle rifle.

In an embodiment, a check valve or orifice at each end of the piston cooling nozzle rifle to restrict lubrication fluid flow from the piston cooling nozzle rifle into the second and third secondary rifles. In an embodiment, the bypass extends through the block and around a side of one of the cylinders for connection to the piston cooling nozzle rifle. In an embodiment, the bypass is not directly connected to the main rifle.

In another aspect, a lubrication system for an internal combustion engine includes a sump for storing lubrication fluid, a filter device for filtering lubrication fluid from the sump, a main rifle in the engine connected to the filter device to receive filtered lubrication fluid from the filter device, a plurality of secondary rifles connecting the main rifle to a plurality of engine components to provide filtered lubrication fluid to the plurality of engine components, and a bypass connected to one of the secondary rifles to bypass the filter and the main rifle and circulate unfiltered lubrication fluid directly to the connected one of the secondary rifles.

In an embodiment, the bypass includes a pressure-responsive valve that automatically opens in response to a pressure of the lubrication fluid exceeding a threshold pressure. In an embodiment, the one of the secondary rifles is a piston cooling nozzle rifle connected to piston cooling nozzles.

In an embodiment, the bypass is formed in part by a rifle through a block of the engine and in part by a passage between the block and a cylinder liner of a cylinder of the internal combustion engine. In an embodiment, the passage changes in elevation from one side of the cylinder to another side of the cylinder. In an embodiment, the passage gravity drains into the one of the secondary rifles.

In an embodiment, the bypass is not directly connected to the main rifle.

In another aspect, a method for circulating lubrication fluid in a lubrication fluid system of an internal combustion engine includes circulating filtered lubrication fluid from a filter device through a main rifle of the internal combustion engine to a plurality of components of the internal combustion engine; and, in response to a filter bypass condition, bypassing the filter device and the main rifle to circulate unfiltered lubrication fluid to a first subset of the plurality of components that are downstream of a second subset of the plurality of components.

In one embodiment, the method includes opening a valve in response to the filter bypass condition to bypass the filter device and the main rifle to circulate the unfiltered lubrication fluid. In an embodiment, the filter bypass condition is a pressure of the lubrication fluid exceeding a threshold pressure.

Any of the embodiments disclosed herein may be combined with one or more other embodiments unless otherwise excluded.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine including a block, a plurality of components supported by the block, and a lubrication fluid for lubricating the plurality of components;

a lubrication fluid circuit for circulating a supply of the lubrication fluid to lubricate the plurality of components, the lubrication fluid circuit including:

a sump for storing lubrication fluid to be filtered;

a filter connected to the sump for filtering lubrication fluid upstream of the plurality of components;

a main rifle in the block connected to the filter for receiving filtered lubrication fluid for distribution to the plurality of components through a plurality of secondary rifles in the block that are connected to the main rifle; and a bypass connected to receive unfiltered lubrication fluid that bypasses the filter, wherein the bypass is directly connected to at least one of the plurality of secondary rifles downstream of the main rifle.

2. The system of claim 1, wherein the bypass includes a pressure-responsive valve that normally blocks the flow of lubrication fluid through the bypass, the pressure-responsive valve automatically opening in response to a lubrication fluid pressure above a predetermined threshold.

3. The system of claim 1, wherein the plurality of components includes a number of piston cooling nozzles and the at least one of the plurality of secondary rifles that is connected directly to the bypass is a piston cooling nozzle rifle.

4. The system of claim 3, wherein the bypass includes a first part in the block extending from a cylinder housed by the block toward the filter, a second part extending from the cylinder to the piston cooling nozzle rifle, and a third part connecting the first and second parts that is formed around the cylinder between the block and a liner of the cylinder.

5. The system of claim 4, wherein the third part changes in elevation from the first part to the second part.

6. The system of claim 4, wherein the third part is wrapped around a part of a perimeter of the cylinder.

7. The system of claim 1, wherein the bypass is not directly connected to the main rifle.

8. The system of claim 1, wherein the plurality of secondary rifles includes:

a first secondary rifle along a first side of a plurality of cylinders housed in the block;

a second secondary rifle extending from a first end of the first secondary rifle along a first end of the block;

a third secondary rifle extending from a second end of the first secondary rifle along a second end of the block; and a piston cooling nozzle rifle along a second side of the plurality of cylinders that connects the second secondary rifle and the third secondary rifle, wherein the bypass is directly connected to the piston cooling nozzle rifle.

9. The system of claim 8, further comprising a check valve or orifice at each end of the piston cooling nozzle rifle to restrict lubrication fluid flow from the piston cooling nozzle rifle into the second and third secondary rifles.

10. The system of claim 8, wherein the bypass extends through the block and around a side of one of the cylinders for connection to the piston cooling nozzle rifle.

11. A lubrication system for an internal combustion engine, comprising:

a sump for storing lubrication fluid;

a filter device for filtering lubrication fluid from the sump;

a main rifle in the engine connected to the filter device to receive filtered lubrication fluid from the filter device;

a plurality of secondary rifles connecting the main rifle to a plurality of engine components to provide filtered lubrication fluid to the plurality of engine components; and a bypass connected to one of the secondary rifles downstream of the main rifle to bypass the filter and the main rifle an circulate unfiltered lubrication fluid directly to the connected one of the secondary rifles.

12. The system of claim 11, wherein the bypass includes a pressure-responsive valve that automatically opens in response to a pressure of the lubrication fluid exceeding a threshold pressure.

13. The system of claim 11, wherein the one of the secondary rifles is a piston cooling nozzle rifle connected to piston cooling nozzles.

14. The system of claim 11, wherein the bypass is formed in part by a rifle through a block of the engine and in part by a passage between the block and a cylinder liner of a cylinder of the internal combustion engine.

15. The system of claim 14, wherein the passage changes in elevation from one side of the cylinder to another side of the cylinder.

16. The system of claim 15, wherein the passage gravity drains into the one of the secondary rifles.

17. The system of claim 11, wherein the bypass is not directly connected to the main rifle.

18. A method for circulating lubrication fluid in a lubrication fluid system of an internal combustion engine, comprising:

circulating filtered lubrication fluid from a filter device through a main rifle of the internal combustion engine to a plurality of components of the internal combustion engine; and in response to a filter bypass condition, bypassing the filter device and the main rifle to circulate unfiltered lubrication fluid to a first subset of the plurality of components that are downstream of a second subset of the plurality of components, wherein the first subset of the plurality of components are connected to at least one secondary rifle that receives the bypassed unfiltered lubrication fluid downstream of the main rifle.

19. The method of claim 18, further comprising opening a valve in response to the filter bypass condition to bypass the filter device and the main rifle to circulate the unfiltered lubrication fluid.

20. The method of claim 19, wherein the filter bypass condition is a pressure of the lubrication fluid exceeding a threshold pressure.

* * * * *